US005836749A

United States Patent [19]

Novacek et al.

[11] Patent Number: 5,836,749

[45] Date of Patent: Nov. 17, 1998

[54] PISTON TYPE LIQUID FUEL PUMP WITH AN IMPROVED INLET VALVE

[75] Inventors: Margaret C. Novacek, South Lyon; Gregg T. Black, Livonia, both of Mich.

[73] Assignee: Chrysler Corporation, Auburn Hills, Mich.

[21] Appl. No.: 768,164

[22] Filed: Dec. 13, 1996

[51] Int. Cl.[6] ..... F04B 1/14

[52] U.S. Cl. ..... 417/269; 417/552; 92/181 P; 123/452

[58] Field of Search ..... 417/269, 552; 92/181 P; 123/452

[56] References Cited

U.S. PATENT DOCUMENTS

| | | | |
|---|---|---|---|
| Re. 25,850 | 9/1965 | Stewart | 417/269 |
| 2,941,475 | 6/1960 | Blair | 417/269 |
| 2,945,444 | 7/1960 | Leissner | 417/269 |
| 3,009,423 | 11/1961 | Leissner | 417/269 |
| 3,221,564 | 12/1965 | Raymond | 417/269 |
| 3,514,223 | 5/1970 | Hare | 417/269 |
| 4,757,795 | 7/1988 | Kelly . | |
| 5,466,130 | 11/1995 | Kobelt | 417/554 |
| 5,515,829 | 5/1996 | Wear et al. . | |

FOREIGN PATENT DOCUMENTS

| | | | |
|---|---|---|---|
| 611078 | 12/1960 | Canada | 417/269 |
| 1167235 | 11/1958 | France | 417/269 |
| 960053 | 6/1964 | United Kingdom | 417/269 |

*Primary Examiner*—Timothy Thorpe
*Assistant Examiner*—Peter G. Korytnyk
*Attorney, Agent, or Firm*—Kenneth H. MacLean

[57] ABSTRACT

A fuel injection system for injecting gasoline or other fuel directly into the combustion chambers of an internal combustion engine including a fuel pump with a plurality of fuel pumping pistons mounted within cylinders formed in a fixed barrel member. Each of the pistons internally contains an improved inlet valving assembly mounted wholly within a bore axially extending in the piston. The valving assembly provides a one-way fluid inletting to the pumping chamber by slight movement of a low mass valving member away from an annular seating surface formed about an inlet passage. Unlike rotary sliding type valves, the subject valve does not move rapidly through and agitate fuel and thereby does not generate any significant degree of undesirable fuel heating thus preventing undesirable fuel vaporization which is detrimental to pumping action of fluid.

8 Claims, 3 Drawing Sheets

126
127
86
122
66
116
60
114
83
82
80
68
58
56
50
67
102
100
120
112
104
105
75
73
44
54
76
5
92
95
88
90

FIG-3
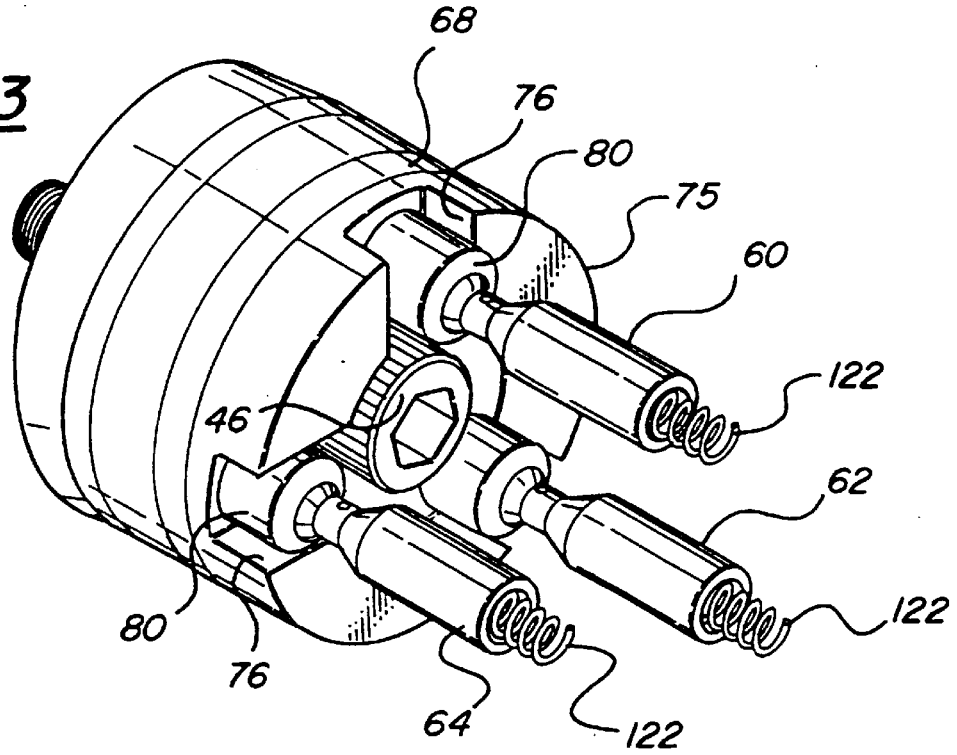
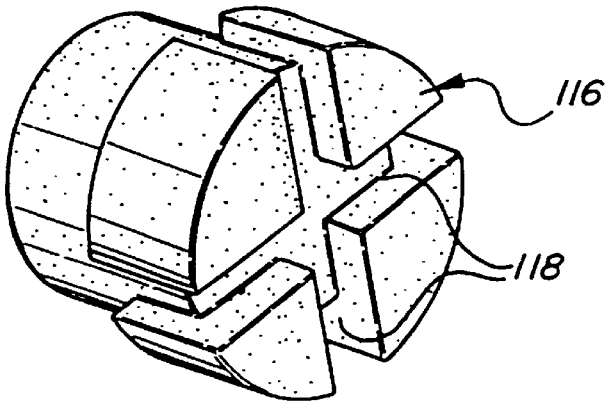
FIG-8
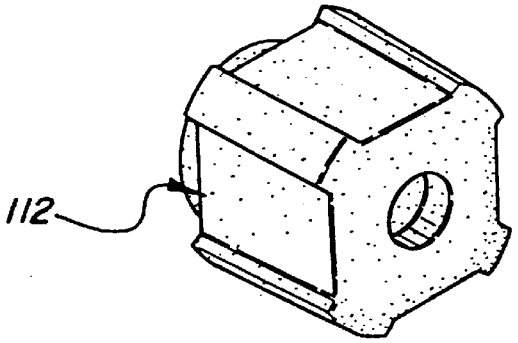
FIG-9

PISTON TYPE LIQUID FUEL PUMP WITH AN IMPROVED INLET VALVE

BACKGROUND OF THE INVENTION

1. Field of Invention

This invention relates to a liquid fluid pump having a rotary swash plate and several axially arranged pumping pistons each mounted in cylinders formed in a fixed barrel member in which the swash plate strokes the pumping pistons through an intermediate bearing unit thereby rotationally isolating the rotating swash plate from the non-rotating pumping pistons thereby permitting the use of a lightweight, responsive reciprocating inlet valve wholly within the piston for regulating liquid fluid flow into the pumping chambers.

2. Description of Related Art

A direct injection fuel system for an internal combustion engine may be designed to inject a fine mist of fuel in a desired pattern directly into a combustion chamber. This is in contrast to indirect injection into an intake manifold and through an intake port as is presently the norm. With this direct injection of fuel, the mean size of fuel particles needs to be of sufficiently small dimension to promote rapid combustion and a more complete ignition, particularly, as compared to a more conventional port injector. Generally however, with direct fuel injection, there is less time afforded during the inlet cycle to inject a desirable and required quantity of fuel for each given operative cycle as compared to port fuel injection. Accordingly, small gas particle size and a relatively great fuel velocity are important. Therefore, the fuel pressure in the fuel conduit or rail leading to the injector must be greater than the pressures normally needed for port type fuel injections. Additionally, the pressure of fuel injected into the cylinder or combustion chamber must be greater than the cylinder pressure of the engine during the time of injection to assure desired opening operation of the injector and a desired full forward flow of the fuel charge from the injectors into the combustion chamber.

Prior to the present invention various types of fuel pumps have been designed for injecting gasoline into internal combustion engines for vehicles. Included among these designs are axial pumping piston and swash plate units incorporating rotary slide valves with resultant sliding interfaces for porting fuel into and out of the pumping chambers of the pistons. The use of such rotary valves results in high frictional heat and has the potential for boiling of the fuel in the pump, particularly at the inlet of a pumping chamber. This frictional heat tends to vaporize fuel. Since vaporized fuel is compressible as compared to incompressible liquid fuel, a pressure loss in the fuel rail will undesirably decrease the effectiveness and service life of such pumps, but primarily and more importantly will cause the associated engine to stall due to poor injection characteristics.

Additionally, prior fuel pumps having sliding rotary valves and resultant friction at the pump inlet results in an increased torque characteristic for the pump which imposes an additional load on the engine and reduces its net horse power output. Also, the sliding interface of rotary valves is susceptible to damage from a wide variety of particulate matter and other foreign material that may possibly find its way in the fuel system. Such matter may scratch or abrade the sealing surface and cause a loss of pressure which can cause the engine to stall. If sufficiently severe, such scratches and abrasions will detract from the subsequent build-up of pressure in the system.

Generally, a fuel such as gasoline is a poor lubricant. Accordingly, a fuel pump for gasoline which has relatively rotating, porting or valving mechanisms which relies on a formation of a hydrodynamic film of gasoline as a lubricant between moving surfaces will experience high friction and perhaps reduced service life.

SUMMARY OF THE INVENTION

With the above in mind, the present invention is drawn to a new and improved fuel pump that has a special load transmitting bearing unit to effectively isolate the rotary input to the pump from the axial stroking of a plurality of pistons so that intake and exhaust valves of the fuel pump have no sliding porting surfaces. In one preferred embodiment of the present invention, the fuel inlet to each pumping piston is through an one-way check valve and the outlet is through an one-way reed valve. The inlet and outlet valves are sufficiently large to permit passage of foreign particles that may be present in the fuel flow. With the stroking pistons and valves of this invention, friction is reduced so that significant heat to cause fuel boiling or vaporization is not generated and a resultant loss of fuel pressure does not occur. In view of the fact that there is no relative turning and sliding valve structure, the inlet valves in this invention seal well at all fuel pump speeds and pressures required by the engine. With the fuel pump of this invention, there is a higher volumetric efficiency over a wide range of engine speeds and fuel pressures.

In the present invention, the pumping elements including the cylinders and axially-moving pistons therein are arranged in a fixed, non-rotating barrel member as opposed to the rotatable swash plate. A new and improved bearing assembly is employed to isolate the non-rotating pistons and barrel assembly from the pump's rotating input shaft and swash plate assembly while at the same time effectively transmitting significant thrust loads from the pumping pistons to the swash plate. It is the relatively great fluid pressure inside the cylinder pumping chambers which generates a large force on the pistons and subsequently imposes the substantial thrust load which is transmitted to the swash plate. To this end, a creeper plate is provided in abutting association with the bearing assembly. Pockets are formed in a side face of the creeper plate and a slipper member is inserted into each of the pockets. Each slipper is connected to one end of a pumping piston by means of a ball-type universal joint. The ball joint includes a spherically shaped socket in the slipper and a conforming spherically shaped head or end portion of the associated pumping piston. This connection generates a very smooth pumping operation and decreases wear.

In the present invention, the bearing assembly transfers loads between the swash plate and the pumping pistons and has a generally annular configuration. The central axis of the annular bearing assembly is not parallel to the input shaft but is perpendicular to the angled surface of the swash plate. The bearing assembly in the preferred embodiment is a cylindrical roller thrust type bearing. This bearing assembly has a rotating race member abutting the angled surface of the swash plate which is operationally acted upon by this angled surface in a manner which permits some sliding contact therebetween. The bearing assembly also includes a non-rotating race member abutting a creeper plate and is spaced from the rotating counterpart. A plurality of roller bearing units or elements are captured between the two races. Specifically, the non-rotating race member and the creeper plate do not rotate about the input shaft but oscillate axially. The piston ends are operatively attached to members which reside in slots formed in the non-rotating creeper plate. This arrangement effectively transfers forces or loads between the swash plate and the pumping pistons. The arrangement shown in the preferred embodiment eliminates any sliding contact between the non-rotating race member off the bearing unit and the creeper plate and therefore wear is greatly reduced.

This arrangement is only useful for a fuel pump with at least three pistons. Since a minimum of three points determine a plane or surface, the preferred pump embodiment of this invention has three pumping pistons each mounted within a cylinder or chamber of a stationary barrel member. The pistons are equally spaced both circumferentially and radially. A spring urges each piston into engagement with the bearing assembly at all times. The piston's even circumferential spacing produces a desired sequential cycling of each pumping piston as a different thickness of the swash plate moves into alignment with the piston. A creeper plate is positioned in abutting relationship with the roller bearing assembly's non-rotating race member and is adapted to move with the pistons as they reciprocate in the pumping chambers. The creeper plate has radially directed slots in which small slipper members reside. Each slipper member is attached to one of the pistons by means of a rotatable joint.

As the swash plate rotates, the contact path defined by the intersection of the piston's axis and the creeper plate is elliptical. In other words, the creeper orbits about the shaft centerline slightly as well as moving axially back and forth. As the creeper orbits, the slippers slide radially in the slots formed in the creeper plate. The slots in the creeper plate permit the slippers to maintain their same circumferential positioning as dictated by the piston mounted in the cylinders of the barrel. Thus, as the creeper plate oscillates both radially inward and outward and axially back and forth, the pistons are subjected to an axially oriented force with little sideways thrust which would tend to promote wear.

The connection between the slippers and the pistons allows angulation therebetween to inhibit wear. One end of the piston is formed with a substantially spherical head and the associated slipper has a semi-spherical cavity to receive the piston end. This effectively acts as a ball joint to distribute loads produced by pressure developed within the piston pumping chambers.

This invention provides a new and improved method of distributing axial loads created by pistons actuated by a swash plate. It employs a special slotted creeper plate that has slots formed on one side face and has a shoulder to operably join it to the non-rotating race member of the bearing assembly. Preferably, the non-rotating race member moves with creeper plate, that is, moves axially and slightly radially but does not rotate. However, the creeper plate is capable of slowly rotating relative to the creeper without significant wear resulting. Importantly, the axial thrust loads are applied and distributed evenly over the whole surface of the non-rotating race member by this slow rotation.

These and other features, advantages and objects of the present invention will be more apparent from the following detailed description and drawing:

BRIEF DESCRIPTION OF THE DRAWINGS

FIG. 3 is a pictorial view showing a rotatable isolator and bearing unit separating the swash plate from the pumping barrel of the pump of FIG. 1;

FIGS. 8 and 9 are enlarged pictorial views of one-way valve components used in the pumping pistons of the pump of FIGS. 1 and 2.

DESCRIPTION OF THE PREFERRED EMBODIMENT

Figure 1:
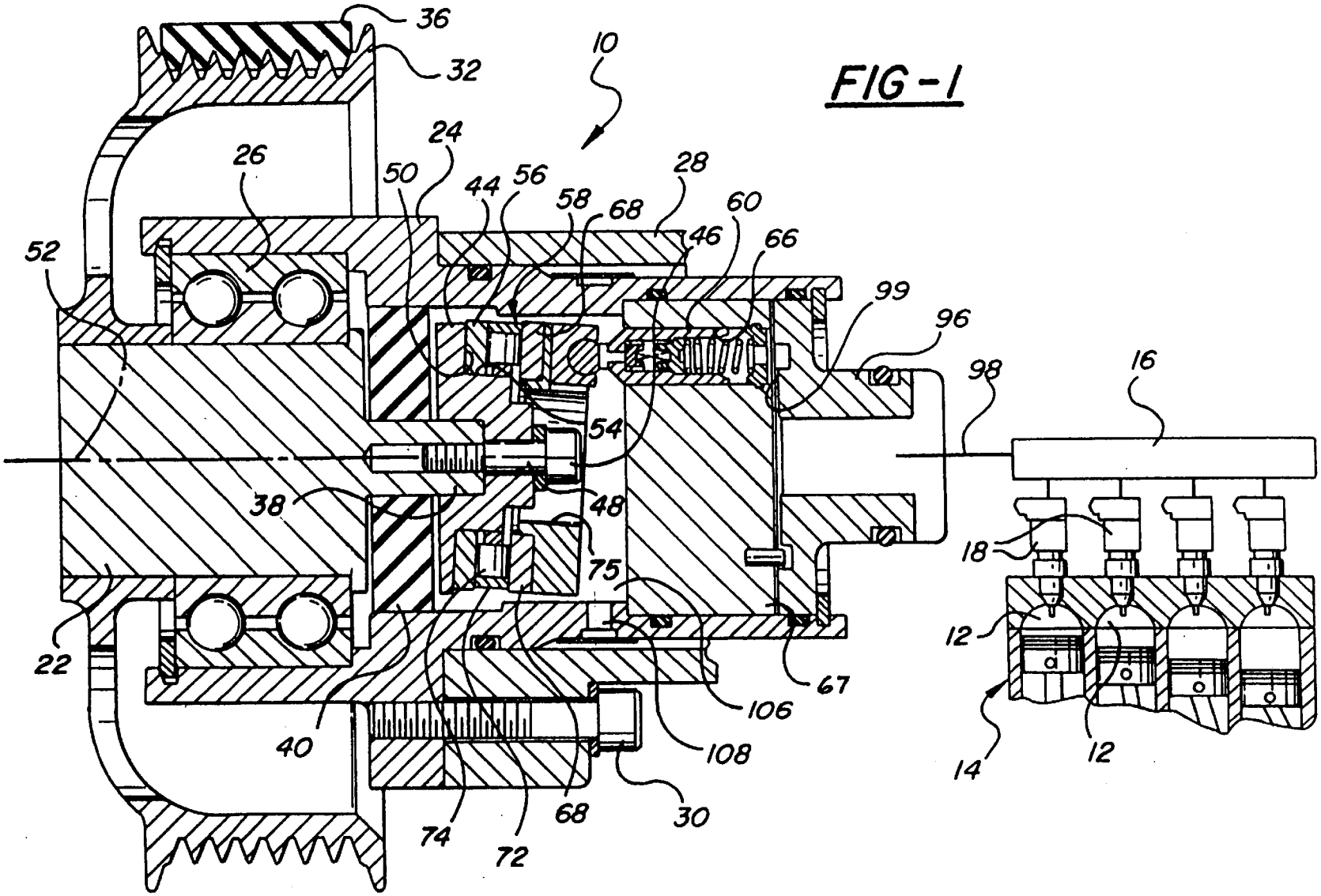
FIG. 1 is a longitudinal cross-sectional view of a swash plate actuated axial piston pump and diagrammatically illustrated fuel injection system.

Turning now in greater detail to the drawings, there is shown in FIG. 1 a fuel pump 10 for pumping gasoline or other fuel at high pressure to the combustion chambers 12 or the cylinders of an internal combustion engine 14 through a common fuel rail 16 and separate fuel injectors 18. These injectors 18 open in accordance to a predetermined sequence for injecting a fine mist of fuel directly into the respective combustion chamber 12.

The fuel pump 10 is rotated or driven through a cylindrical input shaft 22 which is mounted for rotation within a stepped cylindrical pump housing 24 by ball bearing unit 26. A pump housing 24 is supported by a support structure 28 of the engine which forms a generally cylindrical cavity into which the housing 24 partially extends. Housing 24 is attached to structure 28 by threaded fasteners 30 (only one illustrated). A pulley 32 is mounted on the leftward end portion of the input shaft 22 externally of housing 24 so the pulley 32 can be engaged by a drive belt 36 whose movement causes rotation of the pulley and shaft by operation of an associated internal combustion engine 14. A gear train or other suitable drive mechanism could also be utilized.

As shown in FIG. 1, the rightward end of input shaft 22 has a stepped smaller diameter end portion which forms an extended nose portion 38. Portion 38 extends through the inner diameter of an annular fluid seal 40 which is disposed within the housing 24. The nose portion 38 further has an annular swash plate member 44 mounted thereto by an axially extending threaded fastener 46. More specifically, a fastener 46 has a threaded end which extends into a similarly threaded bore formed in the extended nose portion 38 of the input shaft 22. The fastener 46 has a cylindrical midportion 48 which closely resides within a bore in the central hub portion of the swash plate member 44. The fastener 46 secures the swash plate 44 to the nose portion 38 of input shaft 22 so that the shaft 22 and swash plate 44 rotate together as pulley 32 is driven or rotated by movement of the belt 36.

The rotatable swash plate 44 produces axial directed forces for pumping fuel by means of an annular working face or surface 50 which is disposed in an plane inclined from a plane normal to the rotational axis 52 of the shaft 22. The surface 50 is in a plane which is at a predetermined angle or axis of inclination with respect to the rotational axis 52. Swash plate 44 is also formed with an extending cylindrical bearing support shoulder portion 54 adjacent surface 50. The longitudinal axis of the cylindrical portion 54 is perpendicular to the plane of the working face or surface 50 of swash plate 44.

The support shoulder 54 of swash plate 44 operatively mounts a substantially flat, annular-shaped race member 56 of an associated roller bearing unit 58. The race member 56 engages the inclined or angled surface 50 of the swash plate in a manner thereby permitting sliding movement therebetween so that race member 56 rotates with the swash plate 44 but may not rotate at the same rotational rate as the swash plate. The roller bearing unit 58 transmits axially directed thrust forces as created by rotation of the inclined surface 50 of the swash plate 44.

Figures 2, 4, 5, 6, 7:
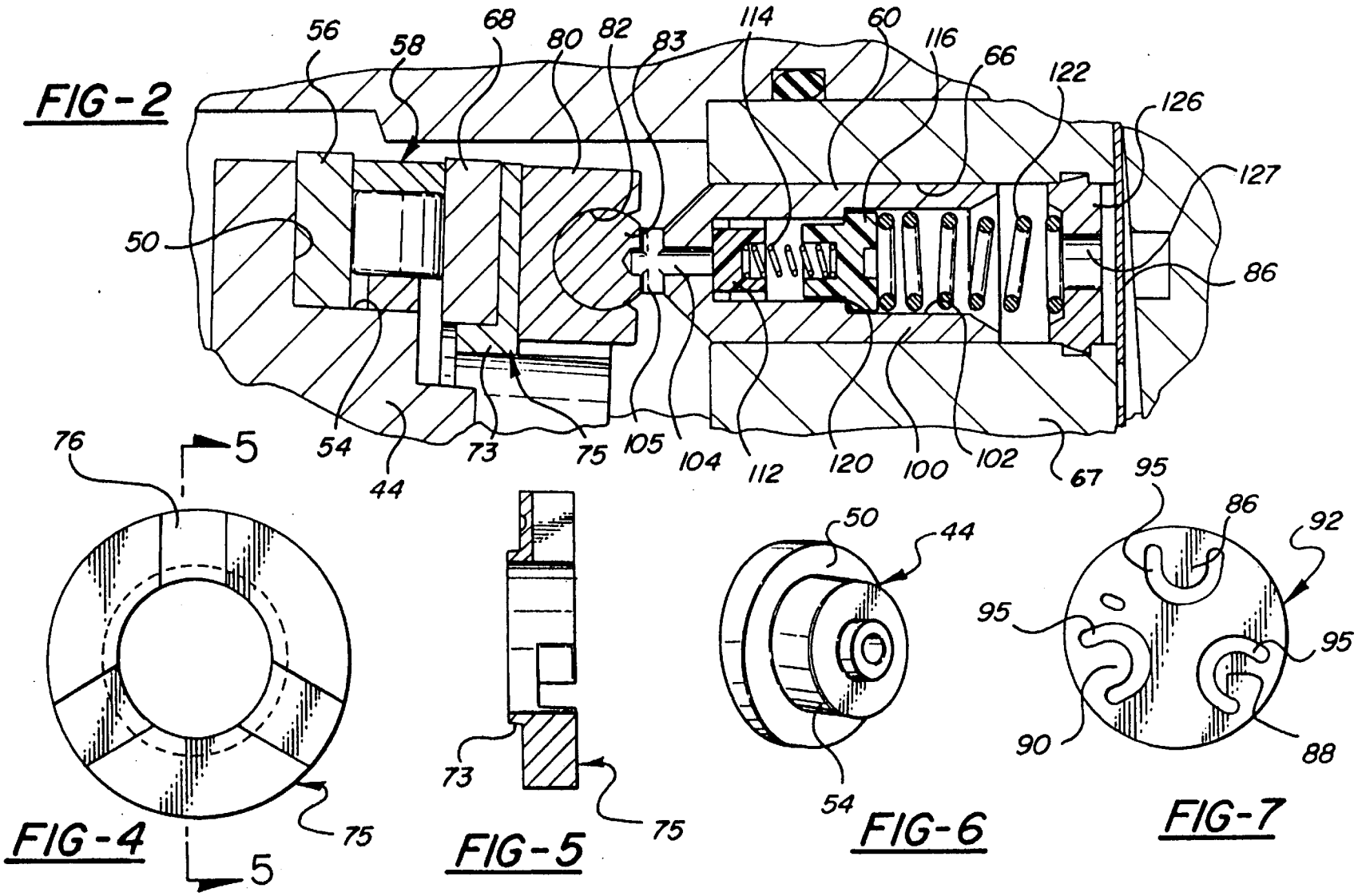
FIG. 2 is an enlarged view of a portion FIG. 1.
FIG. 4 is a front view of a creeper plate element parts used in the pump of FIG. 1.
FIG. 5 is a cross-sectional view of the creeper plate element of FIG. 4 taken generally along sight line 5—5 of FIG. 4.
FIG. 6 is a pictorial view of a swash plate used in the pump of FIG. 1.
FIG. 7 is a front view reduced in scale of a valve plate element used in the pump of FIG. 1.

In FIG. 3, a plurality of pumping pistons 60, 62 and 64 are shown in axial alignment with the pump's rotation axis 52 established by shaft 22. The roller bearing unit 58 isolates three pistons 60, 62, and 64 from the rotation movement of input shaft 22 and swash plate 44. As best shown in FIGS. 1 and 2, using piston 60 as an example, each piston is operatively mounted for axial reciprocation and resultant pumping motion in a cylinder or pumping chamber 66. Each chamber 66 is formed in an associated cylindrical barrel member 67 which is held stationary within the housing 24 of pump 10.

Referring again to FIG. 2, attention is directed to a thrust-load transmitting second race member 68 of the roller bearing unit 58. This second race member 68 is spaced axially away from the corresponding first rotating race member 56 by a plurality of cylindrical rollers 74 which are sandwiched between the race members 56 and 68. Note that second race member 68 is spaced axially away from the edge of support shoulder 54. The positioning of the individual rollers 74 primarily in the radial direction is maintained by a cage assembly 72 while the rollers themselves maintain the axial spacing between race members 56 and 68. Resultantly, each of the rollers 74 is free to rotate about its individual axis when there is relative rotational movement between the first and second race members 56 and 68. This is caused by the rotation of the first race member 56 along with the swash plate 44 and the substantial non-rotation of the second race member 68 which is restrained as more fully explained hereinafter.

As best seen in FIG. 1, an generally annular-shaped creeper plate 75 is positioned in abutting relationship to the second race member 68. The exact configuration of the creeper plate 75 is best shown in FIGS. 4 and 5. Creeper plate 75 consists of a relatively thick, substantially flat body which also includes a protruding face shoulder portion 73. As best shown in FIG. 2, this face shoulder 73 extends into the inner diameter of the second race member 68 and serves to pilot or position it.

As best seen in FIG. 4, the creeper plate 75 has three equally spaced pockets 76 formed in one face. Each of the three pockets 76 receives or retains a slipper member 80 therein, as illustrated in FIG. 2. A semi-spherical cavity 82 is formed in an end of each of the slippers 80 which is adapted to receive a spherical head portion 83 of one of the pumping pistons 60, 62, or 64. The connection provided by the cavity 82 and head portion 83 creates a ball-type universal joint between the creeper plate 75 and a respective piston. The cavities 82 are configured to receive the head portions 83 by a forceful insertion so that the members 80 and 83 are thereafter retained together. To accomplish this assembly, it might be desirable to elevate the temperature of the slipper member and lower the temperature of the piston to better accomplish the tight insertion therebetween. It is thought that with some pumps operating in some particular situations, the slipper members may not be necessary and that the head portions of the pistons might be successfully mounted directly into slots or pockets formed in the creeper plate.

As previously stated, the pumping pistons 60, 62, 64 are reciprocally mounted in cylindrical pumping chambers formed in the barrel member 67. Chamber 66 shown in FIG. 2 is an example of the piston/chamber arrangement. The chambers 66 are formed in bores which extend completely through the body of the barrel member 67. The ends of each of these chambers 66 furthest from the swash plate 44 is normally covered by reed valves 86, 88, 90 which are formed in a flattened annular valve plate 92 as shown in FIG. 7. This plate has three semicircular and radially spaced cutouts 95 which define the three reed valves 86, 88, 90. The valves 86, 88, and 90 normally register with and cover the outer ends of the three associated pumping chambers 66. As seen in FIG. 1, the valve plate 92 is held to the left against the rightward end of the barrel 67 by a fuel outlet fitting 96. Fitting 96 is fluidly connected to the fuel rail 16 by a line or conduit 98 as schematically shown in FIG. 1.

The end interface 99 of fitting 96 has a plurality of concavities placed adjacent the valve portions 86, 88, and 90 to allow flexure of the normally closed valves during a pumping stroke of the associated piston so that the pumping chambers are serially opened to allow the pistons to move fuel at high pressure to the fuel rail 16.

As can be best understood by reference to FIGS. 1 and 2, the configuration of each pumping piston 60, 62 and 64 is the same. Each piston consists of a cylindrical body 100 formed with an interior bore 102 which forms an interior passage which communicates with the interior 106 of the pump housing 24 through an axial connector passage 104 and a cross passage 105. The pump interior 106 receives a supply of low pressure fuel by flow through an inlet passage 108 in the housing 24 which is overlaid by a screen.

As best shown in FIG. 2, the piston's connector passage 104 is normally blocked by a one-way valve element 112 which is yieldably held in its closed blocking position by a light helical spring 114. The other end of the spring 114 seats against a spring seat member 116 which is secured within the interior 102 of the piston. Member 116 has outer fuel passages 118 formed within its outer surface as best seen in FIG. 8. The member 116 is held in an intermediate position within the interior of the piston against an annular shoulder 120 by a relatively heavy coil spring 122. The rightward end of spring 122 is secured in the pumping chamber 66 by a retaining ring member 126 which has a fluid passage 127 extending therethrough. The retaining ring member 126 is in turn fixed at an outer edge portion in the pumping chamber by a shoulder or its equivalent formed in the barrel 67.

The force of spring 122 urges the associated piston axially to the left in FIG. 2. to urge the associated slipper member 80 against the creeper plate 75. This in turn urges the creeper plate 75 against the second race member 68 of bearing assembly 58. The resultant leftward axial force maintains the slipper member 80 within a corresponding pocket 76 in the creeper plate 75. The reciprocal mounting of the pistons in the stationary barrel 67 also prevents rotation of the operatively connected slippers 80 and creeper plate 75 about the axis of the input shaft 22. Likewise, the second race member 68 is inhibited from substantial rotation by its contact with the non-rotating creeper plate 75 although some slippage between race member 68 and creeper plate 75 is possible.

Pump Operation

Operation of the engine drives or moves belt 36 to cause rotation of the pulley 32 which is attached to the input shaft 22. This rotates the swash plate 44 which produces a corresponding back and forth axial oscillation of the swash plate's angled or inclined face 50. More specifically, the angle or inclination between surface 50 and a plane normal to the input shaft's axis causes the distance between the surface 50 and a particular piston head to vary at any circumferential position. This of course produces a desired pumping action of an associated piston. Thus, one rotation of the swash plate 44 produces one complete pumping action of the piston causing it to move first to the right and then back to the leftward starting position.

In FIGS. 1 and 2, the pumping piston 60 is shown at the completion of a full compression stroke for full displacement of a particular pumping chamber. Note the alignment of the thickest portion of the swash plate with the piston 60. Simultaneously, the other two pistons are at a midposition of their cycle, one piston part way into its compression stroke and the other piston moving back from a pumping position and thus drawing fuel into the pumping chamber. During this operation, the roller bearing assembly 58 isolates the non-rotating creeper plate 75, slippers 80, and pistons 60 from rotation of the swash plate 44 while transmitting axial loads from the pistons 60, 62, and 64.

In the completed compression or pumping stroke of piston 60 shown in FIGS. 1 and 2, the high fuel pressure and the force of spring 114 maintains the one-way fuel intake valve 112 in its illustrated closed operational position so that fuel in the pumping chamber can only be directed outward past the outlet reed valve 86. Valve 86 responds to the increase in fuel pressure by deflecting to the right so that fuel flows therepast into the fuel rail 16 and to the injectors 18.

Continued rotation of the swash plate 44 from the above described position moves the thickest portion of the swash plate toward another piston. During this period, the arrival of a continuously thinner portion of the swash plate 44 permits spring 122 to urge piston 60 leftward, thus expanding the pumping chamber. During this expansion phase, the outlet reed valve 86 returns to its normal closed operative position to block flow back into the pumping chamber. The decrease of pressure in the pumping chamber relative to the pressure in chamber 106 causes the intake valve 112 to compress spring 114 and draw fuel into the pumping chamber for recharging to prepare that pumping chamber for a subsequent pumping stroke.

An important aspect of this invention is the isolation of the non-rotating pumping components such as the creeper plate 75, the slippers 80 and the pistons 60–66 from the rotating components such as the input shaft 22, the swash plate 44, and the first rotating race member 56. The afore-described creeper plate and slipper arrangement creates only a slow rotation of the second non-rotating race 68 relative to the creeper. Thus, wear and friction are minimized while the pumping loads are transmitted from the pumping pistons to the swash plate. Also, the ball joint configuration of the slippers and pistons transmits axial loads with minimal transmission of side loads.

With this invention, any sliding frictions are minimized using the above identified one-way fuel inlet valves and reed type outlet valves, each of which have no sliding interface to create friction or heat. More particularly, this invention with its improved fuel porting system, which does not rely on hydrodynamic film as a lubricant can be advantageously useful with poor lubricant fluids such as gasoline.

The fuel inlet and outlet openings in the preferred embodiment are large and greater than one 1 mm so that they are able to pass a wide range of debris that may find its way in to the system.

While a preferred embodiment of the invention has been shown and described, other embodiments will now become apparent to those skilled in the art. Accordingly, this invention is not to be limited to that which is shown and described but by the following claims.

What is claimed is:

1. A piston pump for high pressure pumping of low lubricity fuels comprising, (1) a swash plate driven by said input for rotation about an axis and having an annular contact surface inclined with respect to said axis, (2) a bearing assembly having a first annular race mounted on said swash plate and a second annular race parallel to said first annular race and further having an anti-friction bearing unit sandwiched between said first and second races, (3) a stationary barrel member mounted in spaced relation to said swash plate and defining a plurality of cylinders, (4) a pumping piston in each of said cylinders mounted so as to permit axial movements in response to the action of the inclined surface of said swash plate as it is rotated by said input and thereby defining a pumping chamber, (5) a one-way inlet valve assembly associated with each said pumping piston for admitting fluid into said chamber, said inlet valve assembly comprising: an axially extending stepped bore formed in each pumping piston defining a shoulder portion; inlet passage means opening into said stepped bore; a valve seat about said inlet opening to the stepped bore; a valve member with an end adapted to seat against said valve seat annulus when in a closed operative mode; a spring seat forming member engaging said shoulder portion and spaced from said valving member; a first spring extending between said valving member and said spring seat forming member to yieldably urge said valving member against said seat forming annulus; a second spring urging said spring seat forming member against said shoulder to establish a normal axial position thereof in said piston bore whereby upon movement of said pumping piston, defining an inlet mode of operation the valve member moves against said first spring to draw fluid into said stepped bore from said inlet passage and upon an opposite movement of said pumping piston, defining a pumping mode of operation, the valve member is urged by said first spring against said valve seat to prevent flow of fluid back into said inlet passage.

2. The pump with the inlet valving mechanism as set forth in claim 1 in which passage forming means are arranged between the surface forming said stepped bore and adjacent surfaces of said valving member whereby during an inlet mode of operation fluid passes from the inlet passage, then between the valved seat and end of the valving member, through the passage forming means and into the remainder of the stepped bore.

3. The pump with the inlet valving mechanism as set forth in claim 2 in which other fluid passage forming means are arranged between the surface forming said stepped bore and shoulder thereof and said spring seat forming member to thereby permit fluid to flow out from the space between said valving member and said spring seat forming member.

4. The pump with the inlet valving mechanism as set forth in claim 1 in which said second spring has a greater spring load rate than said first spring whereby movement of the pumping piston in the fluid inletting operative mode decreases the pressure in the stepped bore resulting in actuating said first spring to permit opening movement of said valving member away from said seat forming annulus while said second spring urges said spring seat forming member against said shoulder and also urges the piston toward the swash plate.

5. An improved inlet valving mechanism in a pump for liquid fuel in association with a fuel injector for an internal combustion engine having a combustion chamber, the pump including: a housing defining an interior space; the housing defining a fluid inlet and a fluid outlet to the interior space; a rotary input shaft and an operatively connected rotary swash plate in the interior space; a stationary barrel member with at least one cylinder formed therein; a pumping piston supported for reciprocation in the cylinder; the improved inlet valving mechanism comprising: said pumping piston having an axially extending stepped bore formed therein defining a shoulder portion; inlet passage means opening into said stepped bore; a valve seat about said inlet opening to the stepped bore; a valve member with an end adapted to seat against said valve seat annulus when in a closed operative mode; a spring seat forming member engaging said shoulder portion and spaced from said valving member; a first spring extending between said valving member and said spring seat forming member to yieldably urge said valving member against said seat forming annulus; a second spring urging said spring seat forming member against said shoulder to establish a normal axial position thereof in said piston bore whereby upon movement of said pumping piston, defining an inlet mode of operation, the valve member moves against said first spring to draw fluid into said stepped bore from said inlet passage and upon an opposite movement of said pumping piston, defining a pumping mode of operation the valve member is urged by said first spring against said seat forming annulus to prevent flow of fluid back into said inlet passage.

6. The improved inlet valving mechanism as set forth in claim 5 in which passage forming means are arranged between the surface forming said stepped bore and adjacent surfaces of said valving member whereby during an inlet mode of operation fluid passes from the inlet passage, between the spaced seat forming annulus and end of the valving member, through the passage forming means and into the remainder of the stepped bore.

7. The improved inlet valving mechanism as set forth in claim 6 in which other fluid passage forming means are arranged between the surface forming said stepped bore and shoulder thereof and said spring seat forming member to thereby permit fluid to flow out from the space between said valving member and said spring seat forming member.

8. The improved inlet valving mechanism as set forth in claim 5 in which said second spring has a greater spring load rate than said first spring whereby movement of the pumping piston in the fluid inletting operative mode decreases the pressure in the stepped bore resulting in actuating said first spring to permit opening movement of said valving member away from said seat forming annulus while said second spring urges said spring seat forming member against said shoulder and also urges the piston toward the swash plate.

* * * * *